US006212989B1

(12) United States Patent
Beyer et al.

(10) Patent No.: US 6,212,989 B1
(45) Date of Patent: Apr. 10, 2001

(54) HIGH PRESSURE, HIGH TEMPERATURE WINDOW ASSEMBLY AND METHOD OF MAKING THE SAME

(75) Inventors: Richard A. Beyer, Baltimore, MD (US); Gregory C. Burke, Hanover, NH (US); John J. O'Reilly, West Orange, NJ (US); David C. Smith, Vally Falls, NY (US); Henry Kerwien, Augusta, NJ (US); Mark Todaro, Cohoes, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/305,792

(22) Filed: May 4, 1999

(51) Int. Cl.[7] ..... F41A 3/00; B65D 25/54

(52) U.S. Cl. ..... 89/17; 89/27.11; 102/201; 220/662; 220/361; 220/240

(58) Field of Search ..... 89/17, 27.11; 102/201; 220/662, 663, 240, 361

(56) References Cited

U.S. PATENT DOCUMENTS

| | | | | |
|---|---|---|---|---|
| 3,556,038 | * | 1/1971 | Wolfe | 114/173 |
| 4,169,309 | * | 10/1979 | Meginnis | 29/447 |
| 4,930,418 | * | 6/1990 | Folsom | 102/201 |
| 5,212,339 | * | 5/1993 | Piltch | 102/202 |
| 5,234,526 | * | 8/1993 | Chen et al. | 156/345 |

OTHER PUBLICATIONS

Stromberg, H.D. and Schock, R.N., "A Window Configuration for High Pressure Optical Cells," The Review of Scientific Instruments, vol. 41 (1970), pp. 1880–1881.

Marley et al., N.A., "High Temperature and Pressure System for Laser Raman Spectroscopy of Aqueous Solutions," The Review of Scientific Instruments, vol. 59 (1988), pp. 2247–2253.

Gorbaty, Y.E. and Bandarenko, G.V. "Soldered High–Pressure High–Temperature Sapphire Window," The Review of Scientific Instruments, vol. 65 (1994), pp. 2739–2740.

Lentz, H., "A Method of Studying the Behavior of Fluid Phases at High Pressures and Temperatures," The Review of Scientific Instruments, vol. 40 (1969), pp. 371–372.

* cited by examiner

*Primary Examiner*—J. Woodrow Eldred
(74) *Attorney, Agent, or Firm*—Paul S. Clohan, Jr.; U. John Biffoni

(57) ABSTRACT

A window assembly for transmitting light into and from a vessel containing a high pressure, high temperature, highly reactive environment includes a truncated conical window which is substantially transparent to radiation, a truncated conical metal seal which circumferentially engages the window, and a case to which the window and the seal are secured. To facilitate automatic cleaning of the window, the surface of the window which is exposed to the high-pressure environment is seated substantially flush with the high-pressure surface of the case. By initially seating the window assembly by means of mechanical pressing, then subjecting the window assembly to a series of successively higher transient combustion pressures, a window assembly can be fabricated which can withstand prolonged service in a harsh environment such as that encountered in a large caliber artillery cannon or equivalent scientific and industrial applications.

3 Claims, 2 Drawing Sheets

HIGH PRESSURE, HIGH TEMPERATURE WINDOW ASSEMBLY AND METHOD OF MAKING THE SAME

The invention described herein may be manufactured, used, and/or licensed by or for the United States Government.

BACKGROUND OF THE INVENTION

1. Field of the Invention

This invention relates generally to a window assembly for transmitting light into and from a vessel containing a high pressure, high temperature, highly reactive environment. The invention relates more specifically to a window assembly which can be mounted in a pressure vessel, such as the breech of a large caliber artillery cannon, in a manner that allows the high pressure surface of the window to be substantially flush with the high pressure surface of the surrounding metal case.

2. Description of the Related Art

When employed in a weapon such as a large caliber artillery cannon, a window can facilitate the introduction of a pulse of laser light to ignite the propellant charge of the gun. In such service, however, the environment inside the gun to which the window is exposed during firing typically includes a rapid transition from ambient conditions at a pressure of one atmosphere to pressures of 400 MPa (60,000 psi) and flame temperatures near 3000 Kelvin, followed by the return to one atmosphere, in a time of about 20 milliseconds. In addition, high flow velocities of gas are present in the vicinity of the window. Because of the high pressure and gas flow rates, heat transfer rates to the gun wall, the window, and the surrounding mount in which the window is located are very high. Therefore, a window in such service must be very robust in order to survive many hundreds of gun firings without loss of either optical transmission or damage to the pressure seal.

Furthermore, the high-pressure surface of the window must be nearly flush with the surrounding mount in order to allow for rapid automatic cleaning of residue from the window between firings. The window and its seal must survive numerous gun firings without attention beyond automatic cleaning of propellant residue.

A window which employs a 20° full angle conical sapphire window seated in pyrophillite and operating at pressures of up to 12 Kbars (175,000 psi) is described in Stromberg, H. D. and Schock, R. N., "A Window Configuration for High Pressure Optical Cells," *The Review of Scientific Instruments*, Vol. 41 (1970), pp. 1880–1881. Pyrophillite ($AlSi_2O_5(OH)$) is a soft, natural, mineral-like talc that is related to agalmatolite. The ductile seat distributes stress over the entire crystal sealing surface, the curved surface of the window does not need to be polished when so seated, and the compressive strength of the window is aided by placing the window material under compression. Testing of this design during the development of the present invention, however, revealed that this design is unacceptable for the performance requirements in a gun, primarily because the soft material erodes rapidly when exposed to the temperature, chemical corrosiveness, and high gas flow rates of the gun environment. Once the sealing material is eroded from the edge of the window, the window is unsupported in that region and fractures with subsequent pressure pulses.

The use of an 18° full angle conical diamond window with 64 facets seated in a 0.010 inch thick gold foil pre-formed sleeve at approximately 500° C. and 100 MPa (15,000 psi) is described in Marley et al., N. A., "High Temperature and Pressure System for Laser Raman Spectroscopy of Aqueous Solutions," *The Review of Scientific Instruments*, Vol. 59 (1988), pp. 2247–2253. The cost of diamond windows, however, is prohibitive for production applications. When the gold seal concept was tested with sapphire windows in a gun environment, it was found to be satisfactory for short-term application. After a number of gun cycles, however, the gold was eroded by the gun gases, and the windows failed.

A method of soldering cylindrical sapphire windows into a device used at 850K and 200 MPa (30,000 psi) is described in Gorbaty, Y. E. and Bandarenko, G. V., "Soldered High-Pressure High-Temperature Sapphire Window," *The Review of Scientific Instruments*, Vol. 65 (1994), pp. 2739–2740. Testing of this design during the development of the present invention, however, revealed that the rapid pressure and temperature cycling to which the window is exposed in a gun application causes failure in sapphire windows mounted in accordance with this technique.

The use of sapphire cylinders sealed on the cylinder surface at conditions of up to 450° C. and 360 MPa (52,000 psi) is described in Lentz, H., "A Method of Studying the Behavior of Fluid Phases at High Pressures and Temperatures," *The Review of Scientific Instruments*, Vol. 40 (1969), pp. 371–372. Because this design uses a deeply recessed window which is held in place by a mechanical retainer, however, it is not applicable for flush mounting.

A device employing a conical window shape and the aforementioned sealing techniques is described in U.S. Pat. No. 5,124,555 to Hartl. The disclosed device is not suitable for the present application, however, because the window is mounted substantially below the metal case surface, and the technique cannot be adapted for flush, or even near-flush, window mounting. In a gun application the recessed region on the high-pressure side of a window mounted according to this design would fill with residue after a small number of cycles and become unusable. The service life of a window with this design is also expected to be much shorter due to loading by the retaining forces on the high-pressure face of the window.

Thus, each of the aforementioned conventional designs have inadequacies which render them unsuitable for use in the service encountered by the present invention. For example, where the seal requires the window to be substantially recessed below the surface of the surrounding material or main body of the chamber, a large amount of solid residue (resulting from the gun propellant combustion) tends to accumulate on the window and in the recessed area. No reasonable rapid and automatic method of cleaning this recessed area is available once the recessed depth is below a few millimeters. An additional design weakness of windows that are recessed with a retainer ring on the high-pressure face is the uneven loading of the window that results. This additional loading may result in a much shorter service life when the window is repeatedly pressure cycled.

Second, hard seals such as soldered windows do not withstand the cyclic loading of repeated gun firings. This is because the window and mount interface must exhibit plastic behavior. Due to the thermal mismatch and the difference in material stiffness (as measured by Young's Modulus) between the steel mount (or similar high-strength, ductile material) and the sapphire window (high-strength, transparent, brittle material), movement must be allowed at the interface while intimate contact and support are maintained.

Finally, while affixing the window to the seat with an adhesive may be possible, ceramic sealants were found to be too inflexible to withstand the repeated temperature and pressure cycles encountered in a gun environment. Softer, i.e., polymeric, sealants erode from the bond area between the window and seat as a result of the high temperature, high-pressure environment, thus leaving the window partially unsupported. The unsupported portion of the window fails on subsequent cycles.

SUMMARY OF THE INVENTION

It is an object of the present invention to provide a window assembly which facilitates the transmission of light into and from a chamber containing a high pressure, high temperature, highly reactive environment. It is a further object of the present invention to provide a window assembly which can withstand repeated exposure to a very rapid transition from ambient conditions to elevated pressures and temperatures, followed by a return to ambient conditions. It is an even further object of the present invention to provide a window assembly which is seated substantially flush with the surrounding case so as to facilitate the automatic cleaning of residue from the high-pressure surface of the window.

Accordingly, the present invention advantageously relates to a window assembly which satisfies each of the aforementioned criteria. The window assembly comprises a truncated conical window which is substantially transparent to radiation, with the window comprising a first end surface having a first diameter, a second end surface parallel to the first end surface and having a second diameter which is smaller than the first diameter, and a truncated conical surface connecting the first end surface and the second end surface. The window assembly further comprises a truncated conical seal of a high ductility metal having a geometry capable of circumferentially engaging the truncated conical surface, and a case to which the window and the seal are secured. The case comprises a surface exposed to the high pressure environment and a truncated conical aperture having a geometry capable of circumferentially engaging the truncated conical seal, with the truncated conical aperture terminating in a through bore contiguous with the second end surface. To facilitate automatic cleaning of the window, the high-pressure first end surface of the window is substantially flush with the high-pressure surface of the case.

The invention further relates to a method of forming the window assembly which includes initially seating the window assembly by means of mechanical pressing, then subjecting the window assembly to a series of successively higher transient combustion pressures, which results in a window assembly which can withstand prolonged service in a harsh environment such as that encountered in a large caliber artillery cannon.

The advantages associated with the present window assembly are numerous. First, from a structural standpoint, the invention provides a sealing surface that does not degrade from the high pressure and temperature of the interior of a gun during multiple firings. The invention provides a soft, resilient, sealing surface which allows slight motion of the window material relative to the surrounding metal case, evenly distributes reactive loads on the window due to thermal or pressure effects, and thus allows use of the assembly for a large number of gun firings. In fact, the invention provides an active sealing system between the window and the case which becomes stronger with the application of the pressure against which it is sealing.

Additionally, use of an optional configuration is possible which substantially increases the force required to remove the window from the case, but which does not add loading to the hot, high pressure, face of the window.

From a maintenance standpoint, the invention provides for the mounting of the high-pressure window in a manner that has no retainer or other surface of the optical window. Thus, the window can be mounted such that its high-pressure surface is flush or nearly flush with the surrounding metal surfaces to provide ready access for cleaning. Finally, the overall cased design of the window assembly facilitates rapid replacement of the unit by relatively unskilled personnel.

BRIEF DESCRIPTION OF THE DRAWINGS

Other objects, features, and advantages of the present invention will become more fully apparent from the following detailed description of the preferred embodiments, the appended claims, and the accompanying drawings. As depicted in the attached drawings:

DESCRIPTION OF THE PREFERRED EMBODIMENTS

Figure 1A:
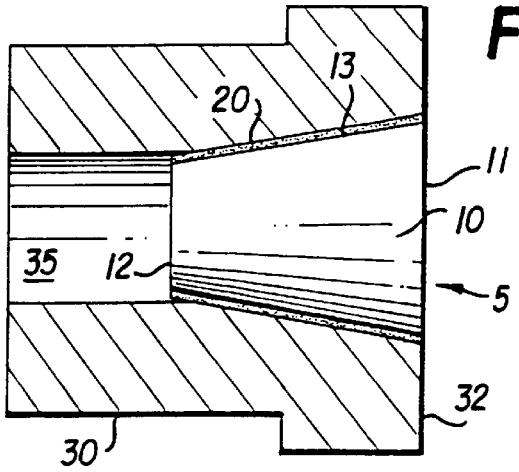
FIG. 1A is a sectional view of a window assembly constructed in accordance with the teachings of a first preferred embodiment of the present invention.
Figure 1B:
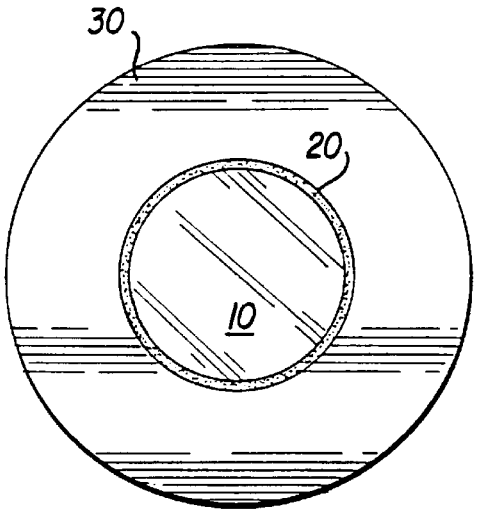
FIG. 1B is a front view of the window assembly of FIG. 1A constructed in accordance with the teachings of the first preferred embodiment of the present invention.

The present invention will be disclosed in terms of the currently perceived preferred embodiments thereof Referring to FIGS. 1A and 1B, a window assembly 5 constructed in accordance with a first preferred embodiment of the present invention is shown. The window assembly 5 comprises a window 10 which has a truncated conical geometry and which is substantially transparent to radiation, such as, for example, light of near infrared wavelength. The window 10 comprises a high-pressure first end surface 11 having a first diameter, a second end surface 12 substantially parallel to the first end surface and having a second diameter which is smaller than the first diameter, and a truncated conical surface 13 connecting the first end surface and the second end surface. The material of window 10 is sapphire or another suitable material that can be fabricated in the truncated conical geometry and which is substantially transparent to radiation.

The window assembly 5 further comprises a truncated conical seal 20 of a high ductility metal having a geometry capable of circumferentially engaging the truncated conical surface 13, and a case 30 having a machined cavity to which window 10 and seal 20 are secured. The case 30 includes a truncated conical aperture having a geometry capable of circumferentially engaging the truncated conical seal 20, and a high pressure surface 32. The truncated conical aperture terminates in a through bore 35 contiguous with the second end surface 12. Through bore 35 has a diameter substantially equal to the diameter of second end surface 12, and serves as a conduit for the transmission of light from the light source to window 10.

Though first end surface 11 and second end surface 12 of window 10 are both depicted as being flat, other surface configurations are possible. Depending upon the particular application, both first end surface 11 and second end surface 12 can instead be curved so as to function as a lens. Alternatively, first end surface 11 is flat and second end surface 12 is curved, or first end surface 11 is curved and second end surface 12 is flat. An optical advantage can be realized with some configurations having a convex surface on first end surface 11.

First end surface 11 and second end surface 12 are optically polished. To facilitate seating of window 10, truncated conical surface 13 can have either a highly polished or a fine ground surface.

In the embodiment depicted in FIG. 1A, window 10 has a first end surface 11 having a diameter of 12.8 mm, a second end surface 12 having a diameter of 7.5 mm, and a truncated conical surface 13 which has a distance, or thickness, from first end surface 11 to second end surface 12 of 15.0 mm. The interior angle defined by the extension of truncated conical surface 13 to terminate in an apex beyond the truncation at second end surface 12 is 20 degrees. Other diameters, thicknesses, and angles, however, can also be used successfully. For example, while the truncated conical shape is essential to distributing the load forces to which the window assembly will be subjected when in service, the specific angle is not critical. The aforementioned dimensions provide a design which has been found to be readily constructed and assembled. The window 10 is fabricated with the sapphire crystalline "c" axis parallel to the axis of through bore 35.

Since metal seal 20 must have a geometry capable of circumferentially engaging truncated conical surface 13 of window 10, seal 20 must be fabricated from a material having specific properties. Specifically, the material must be relatively soft and pliant at the time of assembly, i.e., a high ductility metal; the material must work harden during the seating operations in order to minimize long-term extrusion losses and to maintain full support of the window after the assembly operation; the material must be chemically inert under the conditions encountered inside the pressure vessel; and the material must be impervious to hot oxidizing and reducing atmospheres. Copper, aluminum, niobium, nickel, and tantalum are all possible materials for metal seal 20, with tantalum being the most preferred.

The method of assembling window assembly 5 is as follows. Seal 20 is placed in case 30, and window 10 is then placed in seal 20. Window 10 is then seated in seal 20, and window 10 and seal 20 seated in case 30 by mechanically pressing window assembly 5 together with a laboratory press with a force of at least several hundred pounds up to about 9,000 N (2,000 pounds). Next, the initially seated window assembly 5 is mounted in a semi-closed seating vessel, i.e., one having very limited venting to the atmosphere. A quantity of gun propellants sufficient to achieve transient pressure pulses of 100 MPa (15,000 psi) for about 20 to 50 milliseconds is then burned in this vessel. During this pressure seating step, the pressure in the vessel is increased by the gas generated by the burning propellant; the pressure then rapidly decreases from heat loss to the chamber walls and venting to the atmosphere through a small orifice. This pressure cycle enables window 10 to seat itself securely into seal 20 and obtain full support. Advantageously, the pressure cycle also pre-compresses window 10 to a limited extent, which can enhance the window strength. This process is repeated at increasing pressures until the transparent window material has been seated at the operational pressure at which it is intended to be used, typically up to a pressure in the range of 400 MPa (60,000 psi). The finally seated window assembly 5 is then removed from the semi-closed seating vessel and is ready for installation and service in a pressure vessel.

Figure 2A:
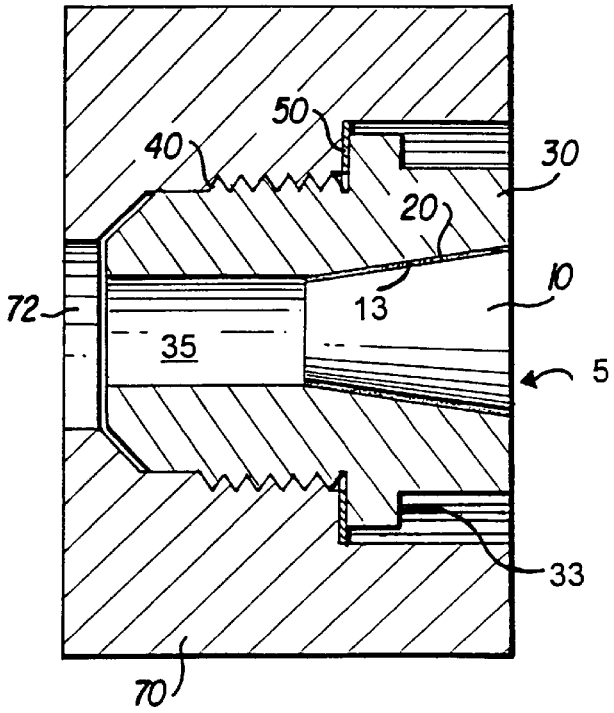
FIG. 2A is a sectional view of a window assembly constructed in accordance with the teachings of the first preferred embodiment of the present invention having a machined case shown in operative cooperation with a pressure vessel.
Figure 2B:
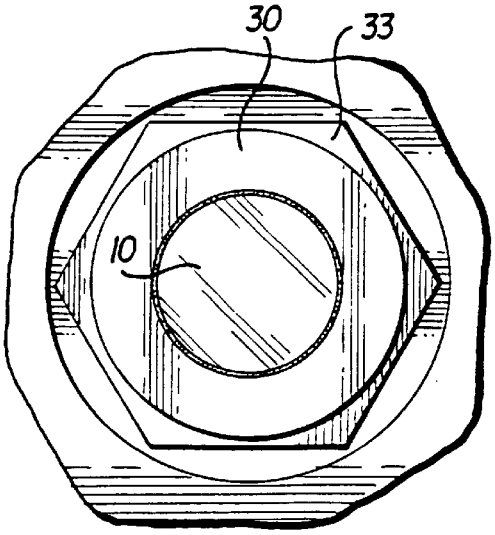
FIG. 2B is a front view of the window assembly of FIG. 2A constructed in accordance with the teachings of the first preferred embodiment of the present invention shown in operative cooperation with a pressure vessel.

Referring to FIGS. 2A and 2B, a window assembly 5 constructed in accordance with a first preferred embodiment of the present invention is shown in operative cooperation with a pressure vessel 70 which has been machined to receive the window assembly. In this embodiment, case 30 is fabricated from high-strength steel, and comprises M24×1 threads 40 to facilitate engagement to a machined cavity in pressure vessel 70, a 25 mm hexagonal end 33 for wrench grip when attaching the case to the pressure vessel, and a flat sealing surface and high-pressure metal case seal 50 which be made of any suitable sealing material. Vessel 70 includes a countersunk through bore 72 to facilitate optical communication with through bore 35 of window assembly 5. Window seal 20 is pre-formed from 99.95% pure tantalum with a thickness of 0.200 mm (0.008 inch) and with a geometry to match the machined cavity of case 30 and truncated conical surface 13 of window 10. The method of assembling window assembly 5 is the same as that described above with respect to FIGS. 1A and 1B.

In the aforementioned embodiments depicted in FIGS. 1 and 2, window 10 is retained securely in case 20 by the frictional forces between the window 10, seal 20, and case 30. For most applications this combination of frictional forces provides sufficient force to hold the window securely in the case.

Figure 3A:
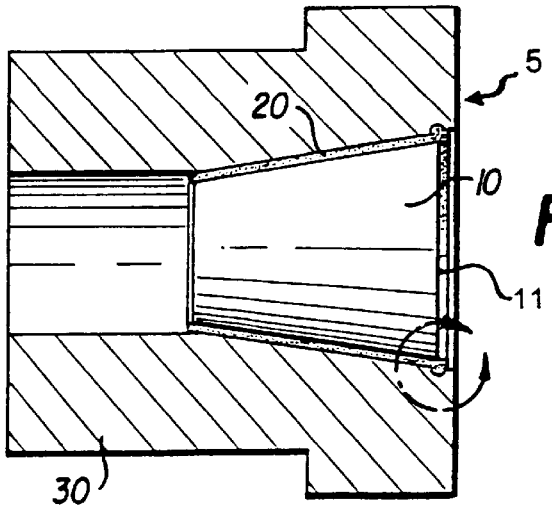
FIG. 3A is a sectional view of a window assembly constructed in accordance with the teachings of a second preferred embodiment of the present invention having an enhanced retention feature.
Figure 3B:
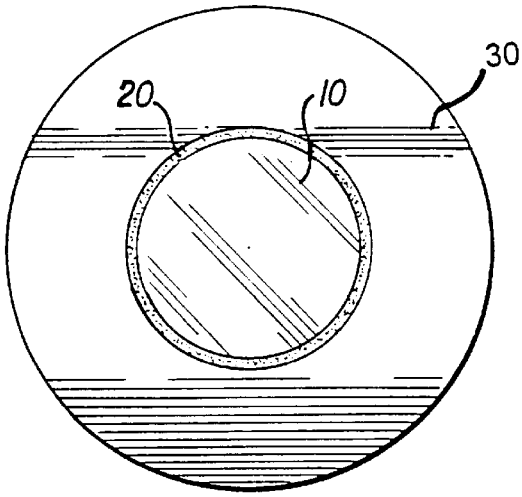
FIG. 3B is a front view of the window assembly of FIG. 3A constructed in accordance with the teachings of the second preferred embodiment of the present invention.
Figure 3C:
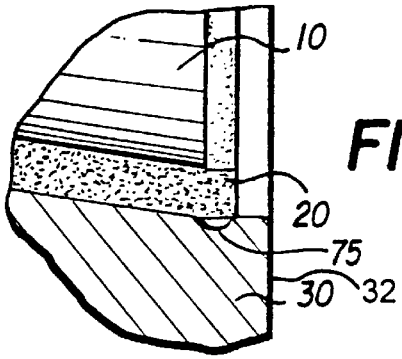
FIG. 3C is an exploded sectional view of the enhanced retention feature of FIG. 3A before engagement of the seal with the case.
Figure 3D:
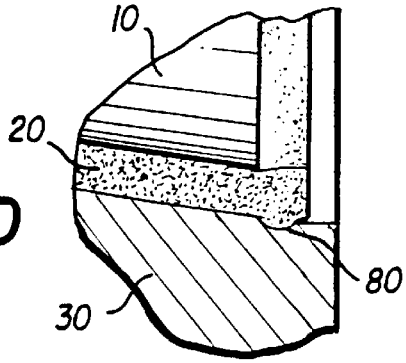
FIG. 3D is an exploded sectional view of the enhanced retention feature of FIG. 3A after engagement of the seal with the case.

For safety reasons or in those environments where excess forces may be present as a result of shock or vibration, a more positive retention of the window 10 is desirable. Referring to FIGS. 3A and 3B, a window assembly 5 constructed in accordance with a second preferred embodiment of the present invention is shown. FIG. 3D illustrates a positive retention lip 80 which increases the force required to displace the window by a factor of greater than 25. As depicted in FIG. 3C, the window 10 is recessed slightly into the case 30. Seal 20 is sized to extend slightly beyond the end of the window, but can be trimmed as required after assembly. A small circumferential undercut 75 having a substantially "U" shape is first made in the surface of case 30 which circumferentially engages the truncated conical seal 20. Circumferential undercut 75 is approximately 0.2 mm deep, and is located approximately 3.5 mm from the high-pressure surface 32 of case 30. Sufficient clearance is present to assemble the components, which appear as depicted in FIG. 3C when first assembled i.e., after mechanical pressing. During the final assembly phase, which constitutes the aforementioned pressure seating step, the soft metal seal 20 extrudes to fill the undercut 75 and form seal retention lip 80, as depicted in FIG. 3D. Seal retention lip 80 provides positive retention of the window 10 in the case 30 by mechanical interference when the soft metal seal 20 has extruded into the undercut 75. This embodiment therefore advantageously provides an enhanced retention force, yet with no diminution of window lifetime. Furthermore, the slight amount of recess, approximately 4 mm, of the high pressure surface 11 of window 10 from the high pressure surface 32 of case 30 in no way hinders automatic cleaning of the window.

The present invention, therefore, provides a window assembly having a sealing surface that does not degrade during prolonged service in a cyclical high pressure, high temperature, environment, and which in fact provides an active sealing system between the window and the case which becomes stronger with the application of the pressure against which it is sealing. By virtue of its substantially flush-mounted window, the assembly also advantageously provides for rapid automatic cleaning of residue from the window.

While only certain preferred embodiments of this invention have been shown and described by way of illustration, many modifications will occur to those skilled in the art. For example, the use of the term "vessel" herein is meant to denote not only embodiments such as large caliber guns, but also includes all other means for containment, e.g., devices employed in scientific and industrial applications which accommodate a high pressure, high temperature, highly reactive environment, and equivalent containers. It is, therefore, desired that it be understood that it is intended herein to cover all such modifications that fall within the true spirit and scope of this invention as defined in the appended claims.

What is claimed is:

1. A window assembly for transmitting light into and from a vessel containing a high pressure, high temperature, highly reactive environment, comprising:

a truncated conical window which is substantially transparent to radiation, said window comprising a first end surface having a first diameter, a second end surface substantially parallel to said first end surface and having a second diameter which is smaller than said first diameter, and a truncated conical surface connecting said first end surface and said second end surface;

a truncated conical seal of a high ductility metal having a geometry capable of circumferentially engaging said truncated conical surface; and a case to which said window and said seal are secured, said case including a surface exposed to said environment and a truncated conical aperture having a geometry capable of circumferentially engaging said truncated conical seal, said truncated conical aperture terminating in a through bore contiguous with said second end surface;

wherein said first end surface of said window is substantially flush with said surface of said case;

wherein said first end surface and said second end surface are curved,and;

wherein said first end surface is convex.

2. A window assembly for transmitting light into and from a vessel containing a high pressure, high temperature, highly reactive environment, comprising:

a truncated conical window which is substantially transparent to radiation, said window comprising a first end surface having a first diameter, a second end surface substantially parallel to said first end surface and having a second diameter which is smaller than said first diameter, and a truncated conical surface connecting said first end surface and said second end surface;

a truncated conical seal of a high ductility metal having a geometry capable of circumferentially engaging said truncated conical surface;

a case to which said window and said seal are secured, said case including a surface exposed to said environment and a truncated conical aperture having a geometry capable of circumferentially engaging said truncated conical seal, said truncated conical aperture terminating in a through bore contiguous with said second end surface;

wherein said first end surface of said window is substantially flush with said surface of said case, and;

wherein said case further comprises a circumferential undercut in said surface of said case which circumferentially engages said truncated conical seal near said surface exposed to said environment, and wherein said seal further comprises a seal retention lip which engages said undercut.

3. A method of forming a window assembly for transmitting light into and from a vessel containing a high pressure, high temperature, highly reactive environment, comprising:

fabricating a truncated conical window which is substantially transparent to radiation, said window comprising a first end surface having a first diameter, a second end surface substantially parallel to said first end surface and having a second diameter which is smaller than said first diameter, and a truncated conical surface connecting said first end surface and said second end surface;

fabricating a truncated conical seal of a high ductility metal having a geometry capable of circumferentially engaging said truncated conical surface;

fabricating a case to which said window and said seal are secured, said case including a truncated conical aperture having a geometry capable of circumferentially engaging said truncated conical seal, said truncated conical aperture terminating in a through bore contiguous with said second end surface;

inserting said seal in said case and said window in said seal;

initially seating said window assembly by mechanically pressing said window into said seal and said window and seal into said case; and finally seating said window assembly by mounting said assembly in a semi-closed vessel and exposing said window assembly to successively higher transient combustion pressures within said vessel;

wherein said case further includes a circumferential undercut in said surface of said case which circumferentially engages said truncated conical seal near said surface exposed to said environment, and wherein said seal further comprises a seal retention lip which engages said undercut.

* * * * *